United States Patent [19]

Schmidt et al.

[11] Patent Number: 4,977,879

[45] Date of Patent: Dec. 18, 1990

[54] MECHANICAL GOVERNOR FOR INTERNAL COMBUSTION ENGINES

[75] Inventors: Gregory R. Schmidt, Port Washington; Peter Hotz, Milwaukee, both of Wis.

[73] Assignee: Briggs & Stratton Corporation, Wauwatosa, Wis.

[21] Appl. No.: 479,084

[22] Filed: Feb. 12, 1990

[51] Int. Cl.[5] ..... F02D 9/08

[52] U.S. Cl. ..... 123/376

[58] Field of Search ..... 123/363, 376, 403

[56] References Cited

U.S. PATENT DOCUMENTS

| | | | |
|---|---|---|---|
| 2,174,676 | 10/1939 | Yarian | 123/376 |
| 2,382,952 | 8/1945 | Armstrong | 123/376 |
| 2,716,397 | 8/1955 | Heinish | 123/376 |
| 3,242,741 | 3/1966 | Catterson | 73/522 |
| 3,276,439 | 10/1966 | Reichenbach | 123/376 |
| 3,749,069 | 7/1973 | Reese | 123/376 |
| 3,841,111 | 10/1974 | Staudt et al. | 123/364 |
| 4,517,942 | 5/1985 | Pirkey et al. | 123/376 |
| 4,793,309 | 12/1988 | Huffman et al. | 123/376 |

FOREIGN PATENT DOCUMENTS 2022863 6/1979 United Kingdom .

*Primary Examiner*—Willis R. Wolfe

*Attorney, Agent, or Firm*—Andrus, Sceales, Starke & Sawall

[57] ABSTRACT

A mechanical speed governor for internal combustion engines includes a centrifugal weight carrier and an arm means that extends through the top side of the upper engine housing. The arm means moves in response to movement by the centrifugal weight carrier to control the amount of fuel delivered for engine combustion. The governor arrangement avoids the oil seal and bell crank levers required in prior art devices.

7 Claims, 2 Drawing Sheets

MECHANICAL GOVERNOR FOR INTERNAL COMBUSTION ENGINES

BACKGROUND OF THE INVENTION

This invention relates to mechanical governors for internal combustion engines, and more particularly to mechanical governors for small engines like those used on lawnmowers, snow blowers and the like.

A number of mechanical governors are known for controlling the speed of an internal combustion engine. Such governors typically control engine speed by controlling the amount of fuel delivered by the carburetor to the combustion chamber. More specifically, the governor is typically connected to a throttle lever which in turn is connected to the engine throttle.

Typical prior art mechanical governors have an arm or lever which extends horizontally through a wall in the engine housing and is then connected to the carburetor by one or more bell cranks. This typical prior art governor has several disadvantages. First, an oil seal is required to seal the hole located on the side of the engine housing. The oil seal is necessary to prevent oil from the engine crankcase leaking out of the engine housing.

A second disadvantage of the typical prior art governor is that additional components such as bell cranks are necessary to link the horizontally-extending arm with the throttle lever of the carburetor. These extra components are required because the position and movement of the crank arm in such governors typically do not permit a simple linkage between the crank arm and the throttle lever. The requirement of bell crank levers increases the cost of the governor, necessitates additional moving parts which wear out, and also makes the governor unnecessarily complicated.

SUMMARY OF THE INVENTION

A speed governor is disclosed for internal combustion engines having a rotating crankshaft, an upper engine housing, and a fuel-delivery control means for controlling the amount of fuel delivered for engine combustion. The governor includes a movement means interconnected with the crankshaft for moving in response to the rate of rotation of the crankshaft, and an arm means, extending in a substantially vertical direction through the top side of the upper engine housing and interconnected with both the fuel-delivery control means and with the movement means. The arm means operates the fuel-delivery control means in response to movement by the movement means.

In a preferred embodiment, the movement means comprises a centrifugal weight carrier that includes a cam gear that engages a crankshaft gear and that rotates in response to rotation by the crankshaft gear. The weight carrier also includes an oil slinger gear that engages the cam gear and rotates in response to rotation by the cam gear, a weight carrier shaft, and at least one flyweight that moves in a radial direction with respect to the weight carrier shaft in response to rotation by the oil slinger gear. The weight carrier also includes a cup member interconnected with the arm means that moves in an axial direction with respect to the weight carrier shaft in response to the radial movement of the flyweight.

The arm means preferably includes a crank arm that engages the cup of the movement means and moves in response to the movement of the cup. The crank arm extends in a substantially vertical direction through the top side of the upper engine housing. The crank arm is interconnected with a lever arm which moves in response to movement by the crank arm. A link arm, interconnected with both the lever arm and with the fuel-delivery control means, moves in response to movement by the crank arm and the lever arm to operate the fuel-delivery control means.

Since the crank arm extends through the top side of the upper engine housing, an oil seal is not needed to prevent oil from leaking from the engine compartment. The present invention also avoids the need for complicated bell cranks or additional linkages between the crank arm and the carburetor's throttle lever.

It is a feature and advantage of the present invention to provide an improved mechanical governor that is also less expensive to manufacture.

It is another feature and advantage of the present invention to provide an improved mechanical governor which also avoids the oil seal and bell cranks of prior art governors.

These and other features and advantages of the present invention will be apparent to those skilled in the art from following detailed description and the attached drawings, in which:

DETAILED DESCRIPTION OF THE PREFERRED EMBODIMENT

Figure 1:
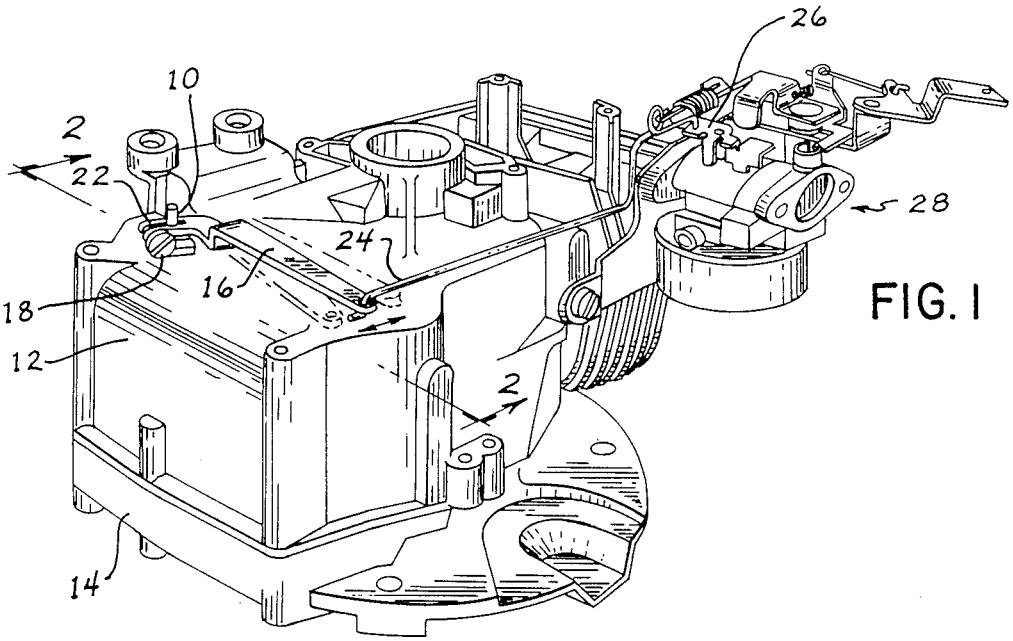
FIG. 1 is a perspective view of an internal combustion engine having a governor according to the present invention.
Figure 2:
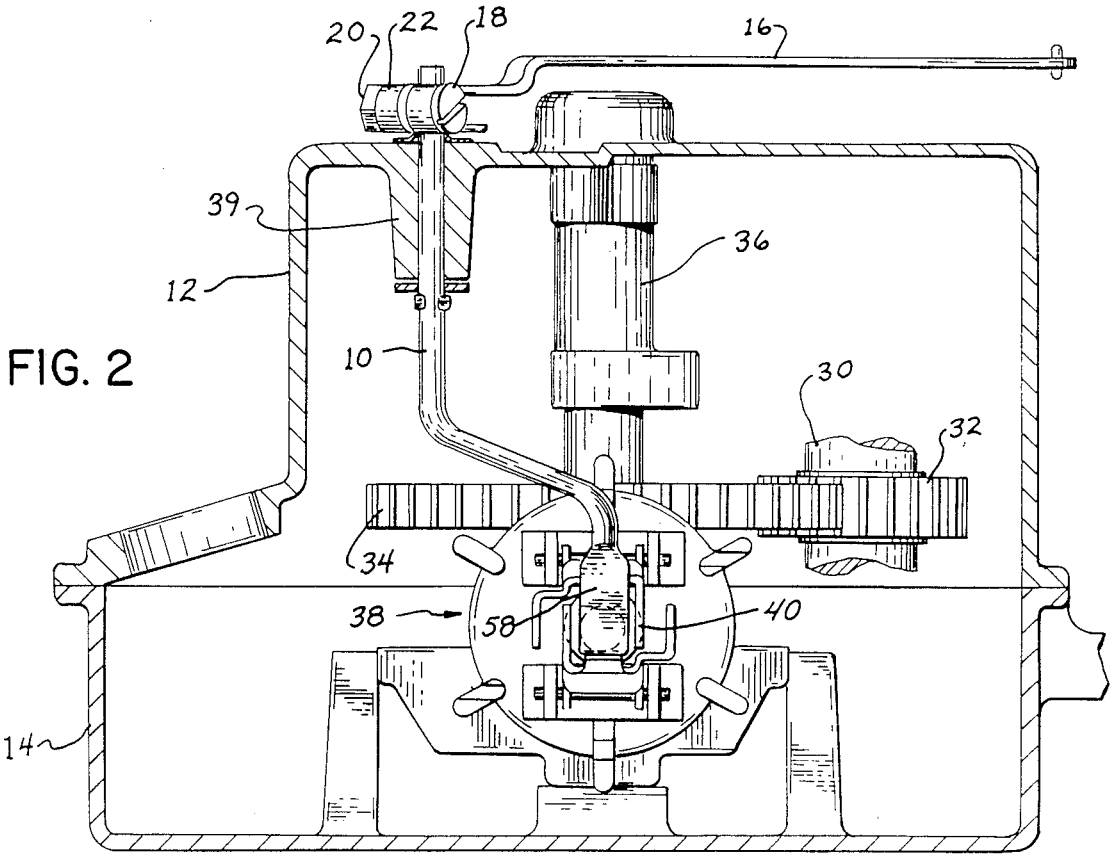
FIG. 2 is a cross-sectional view taken along line 2—2 of the engine depicted in FIG. 1.

The portion of the mechanical governor according to the present invention which lies outside of the engine compartment is depicted in FIG. 1. Referring to FIG. 1, the governor's crank arm 10 extends in a substantially vertical direction through upper engine housing 12 with respect to lower engine housing 14. In its normal operating position, the engine rests on lower engine housing 14, as depicted in FIG. 1. Crank arm 10 is interconnected with a lever arm 16 by means of a nut 18, and a bolt 20 (FIG. 2). One end of lever arm 16 has an integral clamp 22 to which nut 18 and bolt 20 are connected.

The other end of lever arm 16 has a hole for engagement with a link arm 24, whose opposite end is connected to a throttle lever 26 of carburetor 28. More specifically, throttle lever 26 is connected to the engine throttle (not shown) which is internal to carburetor 28. The engine throttle, throttle lever 26, and carburetor 28 control the amount of fuel that is delivered to the combustion chamber of the internal combustion engine. By limiting the amount of fuel available for combustion, the speed of the engine is governed. Movement of crank arm 10, lever arm 16, and link arm 24 helps determine the upper limit of the engine speed.

The cross-sectional view in FIG. 2 depicts some of the key internal components of the mechanical governor. Referring now to FIG. 2, crankshaft 30 has a crankshaft gear 32 for engaging a cam gear 34 located on camshaft 36. The rotation of crankshaft 30 rotates crankshaft gear 32 and cam gear 34 to operate the centrifugal weight carrier 38 as discussed below. Crank arm 10 extends in a substantially vertical direction through the top side of upper engine housing 12 and is held in place by a cast bearing 39. Since the crank arm extends in a substantially vertical direction through the top side of upper engine housing 12, no separate oil seal or bushing is required to prevent crankcase oil from leaking out of the engine compartment. Instead, a simple and inexpensive bearing 39 may be cast when upper engine housing 12 is cast to serve as a guide for crank arm 10 and to provide a low-friction cylindrical surface in which crank arm 10 may freely rotate. The rotation of crank arm 10 in response to actual movement of the cup 40 of centrifugal weight carrier 38 causes lever arm 16 to reciprocate and link arm 24 (FIG. 1) to move to control the amount of fuel delivered by carburetor 28.

Figure 3:
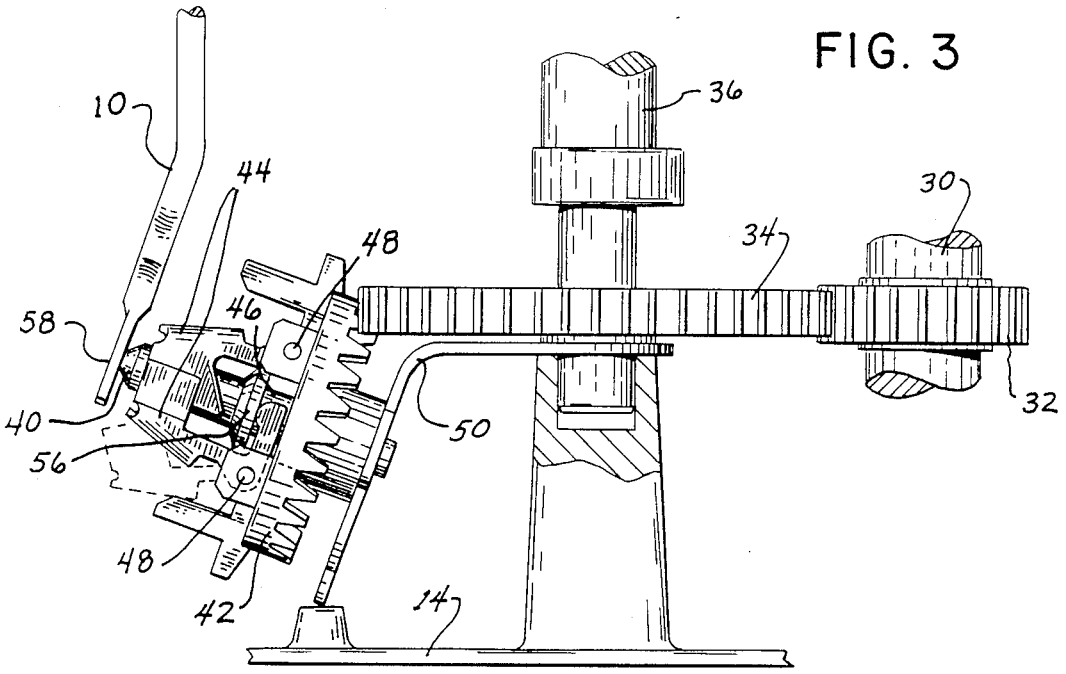
FIG. 3 is a fragmentary view depicting the centrifugal weight carrier in its closed or full load condition.
Figure 4:
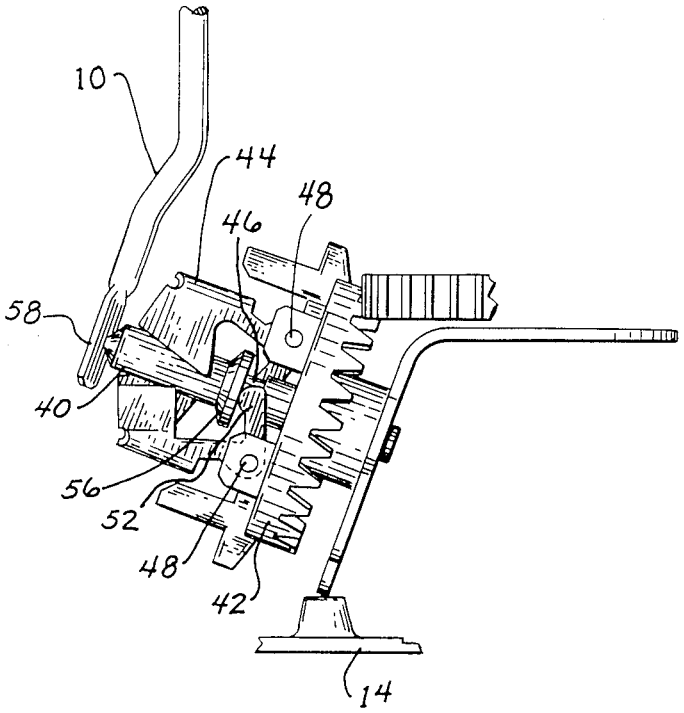
FIG. 4 is a fragmentary view depicting the centrifugal weight carrier when the engine is operating at sufficient speed under a no load condition to activate the governor according to the present invention.

The operation of the centrifugal weight carrier will be described with reference to FIGS.3 and 4. In FIG. 3, rotation of crankshaft 30 causes crankshaft gear 32 and thus cam gear 34 to rotate. The rotation of cam gear 34 causes oil slinger gear 42 to rotate since oil slinger gear 42 is engaged with cam gear 34. Centrifugal flyweights 44 are interconnected with oil slinger gear 42 and rotate therewith. The rotation of oil slinger gear 42 and flyweights 44 causes flyweights 44 to move in an outwardly radial direction with respect to weight carrier shaft 46.

The position of the centrifugal weight carrier if maintained in the engine compartment by means of a bracket 50 having one end encircling cam shaft 36 and a second end resting on lower engine housing 14.

The centrifugal weight carrier as depicted in FIG. 3 corresponds to an ungoverned or full load condition since flyweights 44 and cup 40 are in their retracted positions. FIG. 4 depicts the centrifugal weight carrier at higher engine speeds. As shown in FIG. 4, flyweights 44 have moved radially outward away from weight carrier shaft 44 by pivoting on pins 48. The rear arms 52 of flyweights 44 engage flange 56 located at the bottom of cup 40. The pressure applied by rear arms 52 on flange 56 causes cup 40 to move in an axial direction along carrier shaft 46 and away from oil slinger gear 42. Cup 40 then engages crank arm 10 at its flat portion 58, causing crank arm 10 to rotate and thereby moving lever arm 16 as discussed above.

Although a preferred embodiment of the present invention has been shown and described, it will be apparent to those skilled in the art that other alternate embodiments could be used and still be within the scope of the present invention. Specifically, a wide variety of movement means other than the centrifugal weight carrier movement means discussed herein could be used in combination with the arm means and still be within the scope of the present invention. Therefore, the present invention should be limited only by the following claims.

We claim:

1. A speed governor for an internal combustion engine having a rotating crankshaft, an upper engine housing having a top side and a fuel-delivery control means for controlling the amount of fuel delivered for engine combustion, said governor comprising:

movement means, interconnected with said crankshaft, for moving in response to rotation by said crankshaft; and arm means, extending through the top side of the upper engine housing and interconnected with both said fuel-delivery control means and with said movement means, for operating said fuel-delivery control means in response to movement by said movement means.

2. The speed governor of claim 1, wherein said movement means comprises a centrifugal weight carrier, including:

a cam gear that engages a crankshaft gear on said crankshaft and that rotates in response to rotation by said crankshaft gear;

an oil slinger gear that engages said cam gear and rotates in response to rotation by said cam gear;

a weight carrier shaft;

at least one flyweight that moves in a radial direction with respect to said weight carrier shaft in response to rotation by said oil slinger gear; and a cup, interconnected with said arm means, that moves in an axial direction with respect to said weight carrier shaft in response to the radial movement of said flyweight.

3. The speed governor of claim 1, wherein said arm means includes:

a crank arm that engages said movement means and moves in response thereto;

a lever arm, interconnected with said crank arm, that moves in response to movement by said crank arm; and a link arm, interconnected with both said crank arm and with said fueld-delivery control means, that moves in response to movement by said crank arm to operate said fuel-delivery control means.

4. The speed governor of claim 3, wherein said fuel-delivery control means includes a carburetor.

5. A speed governor for an internal combustion engine having a rotating crankshaft, an upper engine housing having a top side, and a fuel-delivery control means for controlling the amount of fuel delivered for engine combustion, said governor comprising:

a centrifugal weight carrier, including:

a cam gear that engages a crankshaft gear on said crankshaft and that rotates in response to rotation by said crankshaft gear;

an oil slinger gear that engages said cam gear and rotates in response to rotation by said cam gear;

a weight carrier shaft;

at least one flyweight that moves in a radial direction with respect to said weight carrier shaft in response to rotation by said oil slinger gear; and a cup that moves in an axial direction with respect to said weight carrier shaft in response to the radial movement of said flyweight;

arm means, extending through the top side of the upper engine housing and interconnected with both said fuel-delivery control means and with said cup, for operating said fuel-delivery control means in response to the axial movement of said cup.

6. The speed governor of claim 5, wherein said arm means includes:

a crank arm that engages said cup and moves in response thereto;

a lever arm, interconnected with said crank arm, that moves in response to movement by said crank arm; and a link arm, interconnected with both said crank arm and with said fuel-delivery control means, that moves in response to movement by said crank arm to operate said fuel-delivery control means.

7. The speed governor of claim 5, wherein said fuel-delivery control means includes a carburetor.

* * * * *

UNITED STATES PATENT AND TRADEMARK OFFICE

CERTIFICATE OF CORRECTION

PATENT NO. : 4,977,879

DATED : December 18, 1990

INVENTOR(S) : GREGORY R. SCHMIDT ET AL

It is certified that error appears in the above-identified patent and that said Letters Patent is hereby corrected as shown below:

Claim 3, column 4, line 27, delete "fueld delivery" and substitute therefor -- fuel delivery --.

Signed and Sealed this

Twenty-first Day of July, 1992

*Attest:*

DOUGLAS B. COMER

*Attesting Officer*

*Acting Commissioner of Patents and Trademarks*